United States Patent [19]

Knight

[11] 3,997,921

[45] Dec. 21, 1976

[54] BABY GARMENT

[76] Inventor: William E. Knight, 5000 Park Place, Bethesda, Md. 20016

[22] Filed: June 30, 1975

[21] Appl. No.: 591,613

[52] U.S. Cl. ..... 2/75; 2/93; 2/271; 119/96

[51] Int. Cl.[2] ..... A41D 11/00

[58] Field of Search ..... 2/69, 69.5, 271, 75, 2/80, 243 R, 93; 119/96

[56] References Cited

UNITED STATES PATENTS

| | | | |
|---|---|---|---|
| 602,861 | 4/1898 | Lyon | 119/96 |
| 995,781 | 6/1911 | Gallrein | 2/271 |
| 1,524,440 | 1/1925 | Langes | 2/271 |
| 2,325,097 | 7/1943 | Behringer | 2/69.5 X |
| 2,568,304 | 9/1951 | Schoenbrun | 2/80 X |
| 2,707,988 | 5/1955 | Shaub et al. | 2/69.5 X |
| 3,408,703 | 11/1968 | Brandenburg | 2/271 X |
| 3,680,149 | 8/1972 | Standiford | 2/271 |
| 3,789,431 | 2/1974 | Rand | 2/271 X |

*Primary Examiner*—H. Hampton Hunter
*Attorney, Agent, or Firm*—William E. Mouzavires

[57] ABSTRACT

For controlling a child, a baby garment such as a shirt, blouse or jacket is disclosed having a handle incorporated on its upper back preferably on the back of the collar below the downturned collar portion in cases where the garment has a collar. The handle may be stitched directly to the garment or provided through eyelets or rings provided in the garment. In addition, if desired, the handle may be provided with a ring slidable along the handle and which can accommodate a rein or an additional control handle or element.

8 Claims, 4 Drawing Figures

BABY GARMENT

BACKGROUND OF THE INVENTION

Anyone who has cared for small children knows the difficulties that may be encountered in attempting to lead or control them by the arm or hand when they do not wish to be so controlled. The tug-of-war that ensues in many instances, for example, in making ones way through a dense throng or across a busy street or when attempting to hold the child still often endangers life and limb, as well as tempers.

The problem is caused by the fact that when grasped by the arm or hand, a child is still free to undergo considerable range of movement because insufficient leverage is available to control the child. On the other hand, if the child is excessively forced or pulled, the child may lose its footing and present an even greater problem in control. In addition, the child may be injured if sufficient force is applied by grasping the child by the arm or hand.

One well-known method used in the past for controlling a child utilized a harness which had to be fitted about the child. However, placement and removal of such a harness is cumbersome and time consuming. Furthermore, the harness is unsightly.

INVENTION AND OBJECTS

Accordingly, the present invention overcomes the above problem by the provision of a novel baby garment incorporating a handle which may be easily and conveniently grasped by a parent or adult to control the child either in movement or to hold the child still.

Another object of the present invention is to provide such a garment that will provide the above control and yet is susceptible to various aesthetic designs.

A further object of the present invention is to provide such a novel baby garment that may be provided with a control handle without significantly increasing the cost of manufacture thereof. Included herein, is the provision of a baby control handle that may be applied to new or old baby garments with a minimum of skill and expense.

DRAWINGS

Other objects and advantages of the present invention will become apparent from the following more detailed description taken in conjunction with the attached drawings in which.

DETAILED DESCRIPTION

Figure 1:
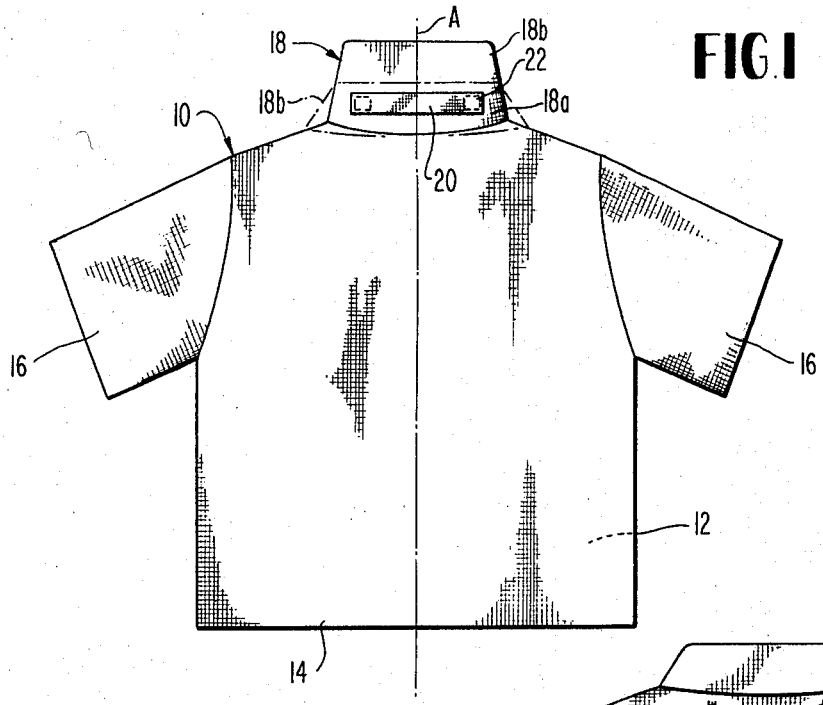
FIG. 1 is an elevational view of the back side of a baby garment embodying the present invention.

Referring to the drawings in detail, and initially to FIG. 1, there is shown, for illustrative purposes only, a baby garment generally designated 10 embodying the present invention; garment 10 being, for example, a shirt, blouse or outer jacket. Garment 10 typically includes a body portion generally designated 12 having a front side (not shown), and a back side 14 and a pair of sleeves 16 as illustrated in FIG. 1. In addition, the specific embodiment includes a collar 18 shown in FIG. 1 as being raised for purposes of illustrating the inventive feature now to be described.

In accordance with the present invention, a control handle is incorporated on the back side of garment 10 and preferably on the back of collar portion 18*a*. When the upper portion 18*b* of collar 18 is turned downwardly for normal use, it will assume the position illustrated in dotted lines in FIG. 1 which will conceal handle 20.

Control handle 20 may be made from any suitable textile material and with sufficient length, for example, about four inches, so as to permit three or four fingers of an adult hand to be placed below the handle 20 for properly grasping the same. The width of the handle in the shown embodiment may be, for example, one-half of an inch.

Any suitable means may be utilized for attaching the handle such as stitching 22 shown or bonding (not shown). Additionally, handle 20 is placed so that the longitudinal axis A of the back of the garment will coincide with the center of the handle equidistant the opposite ends of the handle. Moreover, handle 22 should be situated on the upper half section of the back of the garment so that when the child is controlled through the handle there will be no moment applied to the child tending to upset or tumble the child forwardly.

Figure 2:
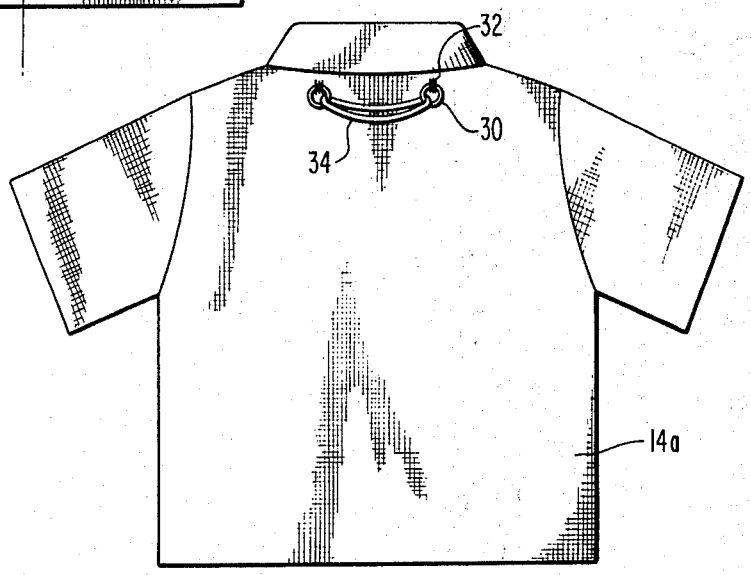
FIG. 2 is a view similar to FIG. 1 but illustrating a modification of a control handle as incorporated in the present invention.

Referring now to FIG. 2, a modified control handle is illustrated including a pair of rings 30 stitched to upper back portions of the garment below the collar in the position illustrated. Rings 30 may be secured to the garment such as by stitching 32 or any other suitable means. The control handle in this embodiment is comprised of a sturdy continuous string 34 of any suitable cloth, plastic or leather material threaded through the rings 30 as shown to be positioned externally of the back side 14*a* of the garment.

Figure 3:
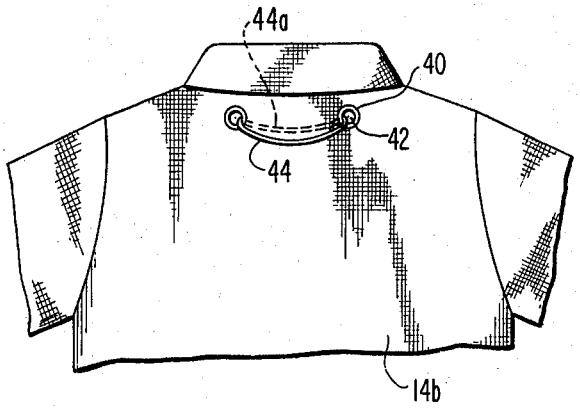
FIG. 3 is a view similar to FIG. 2 with portions removed for clarity and illustrating yet another modification of the invention.

Referring to FIG. 3, another modified control handle is shown wherein a pair of grommets or similar rings 40 are formed in the upper back of the garment below the collar with apertures 42 extending through the garment between the inner and outer side of the back portion 14*b* of the garment. In this embodiment, a continuous string 44 of suitable material is threaded through the grommets 40 with a portion of the string 44*a* positioned on the inside of the back 14*b* of the garment and the remaining portion situated externally of the back 14*b* of the garment as shown.

Figure 4:
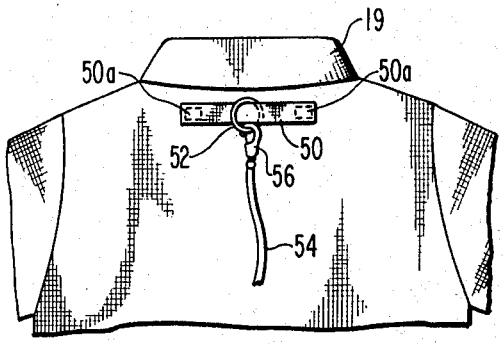
FIG. 4 is a fragmental view similar to FIG. 1 and illustrating yet a further modification of the present invention.

Referring to FIG. 4, another modification of the present invention is illustrated which is similar to that disclosed in FIG. 1 with the exception that the handle 50 in this instance is below collar 19. In addition in this embodiment, a ring 52 is placed about handle portion 50 to be slidable therealong between the opposite secured ends 50*a* of the handle. This permits another control element which could be a handle or a rein such as illustrated by 54 which is secured to the ring 52 by means of a releasable hook 56.

As in the embodiment of FIG. 1, each of the control handles utilized in the modifications of FIGS. 2, 3 and 4 are placed in the upper center portion of the back of the garment with the longitudinal axis A of the back of the garment passing through the mid point of the handles equidistant the opposite ends of the handles. In addition, the control handles of these embodiments are placed within about an inch below the level of the collar of the garment. Such positioning permits an effective control force to be applied to the child which will permit complete control of the child without causing him to be upset or tumble forwardly. In addition, while the child will be controlled through the use of the handle, no injurious forces will be applied to the child.

What is claimed is:

1. In combination with a garment for a baby or child to be worn over the body of the child and having a front side, a back side and neck and shoulder portions; a control handle attached to the upper back side of the garment to be grasped by the hand of an adult for controlling a child wearing the garment, said handle having spaced opposite end portions and extending between the opposite end portions thereof in close proximity to the back side of the garment adjacent to said neck and shoulder portion with the longitudinal axis of the back side of the garment generally coinciding with the mid point of the handle equidistant the opposite end portions of the handle, the length of the handle between said end portion thereof being of length to permit a plurality of fingers of an adult to be placed in the space between the handle and the back side of the garment for grasping the handle, and means permanently attaching the opposite end portion of the handle to the garment so that the handle is a permanent part of the garment at all times and so that the handle is capable of withstanding forces tending to separate the handle from the garment when the child falls or pulls away from a person grasping the handle.

2. The garment defined in claim 1 further including a collar and wherein said handle is attached on the back of the collar.

3. The garment defined in claim 2 wherein said collar has a first portion with said handle being attached thereto, said collar having a second portion which is normally downturned over said first collar portion and concealing the handle.

4. The garment defined in claim 1 wherein said handle is located within approximately 1 inch below the upper end of the garment.

5. The garment defined in claim 4 wherein the length of the handle is approximately 4 inches.

6. The garment defined in claim 1 wherein the opposite ends of the handle are attached to the garment by stitching.

7. The garment defined in claim 1 wherein the opposite ends of the handle are attached to the garment by bonding.

8. A method of controlling a baby or a child that is capable of standing and walking; the steps comprising applying to the child a garment including a neck portion and a back side and a handle having opposite ends permanently attached to the upper back side of the garment closely adjacent the neck portion with the longitudinal center line of the backside of the garment generally coinciding with the mid point of the handle equidistant the ends of the handle, and grasping the handle by the hand placing the fingers around the handle and between the handle and the back side of the garment so that any attempted movement of the child may be prevented by means of the hand firmly gripping the handle.

* * * * *